United States Patent [19]

Lancaster, III et al.

[11] 4,235,062

[45] Nov. 25, 1980

[54] COLLAPSIBLE WEB WRAPPING APPARATUS

[75] Inventors: Patrick R. Lancaster, III; William G. Lancaster, both of Louisville, Ky.

[73] Assignee: Lantech Inc., Louisville, Ky.

[21] Appl. No.: 928,236

[22] Filed: Jul. 26, 1978

Related U.S. Application Data

[63] Continuation-in-part of Ser. No. 911,652, Jun. 1, 1978, Pat. No. 4,204,377.

[51] Int. Cl.[3] ..... B65B 11/04

[52] U.S. Cl. ..... 53/399; 53/441; 53/556; 53/587

[58] Field of Search ..... 53/556, 587, 211, 399, 53/441, 210, 399; 242/7.23, 18 EW, DIG. 2

[56] References Cited

U.S. PATENT DOCUMENTS

| | | | |
|---|---|---|---|
| 3,788,199 | 1/1974 | Jato | 53/587 |
| 4,077,179 | 3/1978 | Lancaster | 53/556 |
| 4,136,501 | 1/1979 | Connolly | 53/441 |

OTHER PUBLICATIONS

"The Digest"—Sep. 1977—by Infra-Pak.
"The Digest"—Dec. 1977—by Infra-Pak.

*Primary Examiner*—John Sipos
*Attorney, Agent, or Firm*—Gipple & Hale

[57] ABSTRACT

A process for automatically making a spiral wrapped unitary package with a single web of stretchable material to form a netting overwrap. A series of loads, each containing a plurality of units are fed one at a time onto a turntable adjacent a film dispenser with the leading edge of the film from the film dispenser being collapsed in width and held by a clamp mechanism mounted on the turntable. The collapsed film web is spirally wrapped around the load to one end of the load and spirally wrapped around the load to the other end to complete a first cycle defining an overwrap netting configuration with a plurality of symmetrical angular spaces. The turntable is then rotated at least 90° to offset the collapsed film web and a second cycle is repeated with the film web being spirally wrapped to overlie part of the originally spirally wrapped film web and reduce the angularly shaped spaces formed by the first cycle. On the return the collapsed film web is tucked under a portion of the collapsed film wrapped around the load.

21 Claims, 14 Drawing Figures

COLLAPSIBLE WEB WRAPPING APPARATUS

RELATED APPLICATIONS

This is a continuation-in-part of U.S. application Ser. No. 911,652, filed June 1, 1978 now U.S. Pat. No. 4,204,377.

BACKGROUND OF THE INVENTION

The present invention generally relates to packaging and more particularly to a method for making unitary packages which hold a plurality of components, each package containing a load wrapped in a web of stretched collapsed film which forms a net-like configuration around the load.

Case packing or boxing is a common way of shipping multiple unit products. The multiple unit products are generally stacked in a corrugated box or are wrapped with kraft paper with the ends of the kraft paper being glued or taped. Another way of shipping such products is by putting a sleeve or covering of heat shrinkable film around the products and shrinking it to form a unitized package. The use of heat shrinkable film is described in U.S. Pat. Nos. 3,793,798; 3,626,654; 3,590,509 and 3,514,920. A discussion of this art is set forth in U.S. Pat. No. 3,867,806.

The present invention provides a simple, reliable and inexpensive method of unitizing multiple unit products into a single wrapped package with a single strand stretched overwrap material that forms a net-like configuration allowing the contents of the package to breathe or allow other advantages such as wrapping of irregular odd shaped loads and minimizing film consumption.

When the present process is compared with other processes currently used to pack products in corrugated boxes and the cost of the corrugated boxes themselves, the invention shows an emormous cost savings. In addition to these factors the invention uses stretch film material, which is less expensive than netting material or perforated stretch film and which also provides product visibility not possible with kraft or corrugated wrapping plus the desirable feature of letting the load "breathe." This feature is especially desirable when live product is packaged and shipped. Furthermore, the present inventive system offers packaging speed, reliability of package seal and energy savings in that less energy is required to package the products.

One problem with shrink and non-cling stretch film packaging in addition to the fact that they do not allow a load to breathe is that the primary strength and reliability of the package is determined by the consistent quality of the seal. These seals depend on a careful maintenance of the sealing jaw and are never as strong as the film itself. The time that it takes to make the seals is a limiting factor on the possible speeds of most shrink systems with the additional problem that some stretchable materials, as for example, stretch netting, or narrow film width cannot be effectively heat sealed.

The present invention does not require a structural seal and therefore can use any type of stretchable material. The invention is designed to function with stretchable film webs such as nylon, polypropolene, P.V.C. or polyethylene which can be stretched in small widths with less force than a stretch net. These film webs are less expensive than the stretch net. The present inventive apparatus utilizes a tucking mechanism which effectively tucks a wrapping of collapsed film under an adjacent wrap while severing the trailing edge of the film web from the load after the load has been spirally wrapped to form a netting package overwrap.

The use of spiral wrapping machinery is well known in the art. One such apparatus is shown by U.S. Pat. No. 3,863,425 in which film is guided from a roll and wrapped around a cylindrical load in a spiral configuration. A carriage drives the film roll adjacent the surface of the load to deposit a spiral overwrap around the load and returns in the opposite direction to deposite another spiral overwrap around the load. Other spiral wrapping apparatus are described by U.S. Pat. Nos. 3,857,486; 3,549,017; 3,412,524; 3,191,289 and 2,716,315.

It has previously been disclosed in U.S. Pat. No. 3,788,199 to spirally wind tapes in a manner that they overlap each other to provide suitable space therebetween when breathability is required. In this reference, a heavy duty bag is prepared by spirally winding stretched tapes of synthetic resin in oppoiste directions, so that they intersect each other to form a plurality of superimposed cylindrical bodies which are bonded together to form a cylindrical network. The spirally wound inner and outer tapes of the superimposed cylindrical body intersect each other at a suitable angle, depending upon the application intended, the preferred embodiment having substatially equal longitudinal transfer strength. In this preferred embodiment the tapes intersect each other at an angle of about 90°. The angle defined by the tapes constituting the cylindrical network may be determined by varying the interrelationship between the travelling speed of the endless belts carrying the tap and the rotating speed of the bobbin holders, which rotate a plurality of tape bobbins to deposit the tape onto the moveable belt. The previously indicated patents rely on heat shrink material, adhesives, a heat seal or the tacky nature of the film to hold the outer layer of wrap in a fixed position.

The turntable clamping assembly described in this specification is disclosed in U.S. Pat. No. 4,077,179. Various patents have described the use of mechanisms for wrapping materials. In U.S. Pat. No. 3,003,297 a complex cutting and holding mechanism is used to place tape on a box and cut it off with the process being repeated for each box. The use of adhesive on the tape to bond it to the package is an integral part of the function of this concept. Without this adhesion quality it would not work either in single, multiple or spiral configurations. The unique design and function of the tucking, clamping and cutting mechanisms in the present invention does not require a bonding or heating of the film in order for the process to operate.

U.S. Pat. No. 2,088,133 discloses a reverse wrapping wire tying machine. In the reference a gripper mechanism holds a band in position with respect to the load to be wrapped and a rotatable ring drive rotates the band around the load until the band has completed more than one wrap of the load and passes over the body of the gripper mechanism. A separator slide is used to separate the leading edge of the band from the underlying band and a second gripper mechanism attaches to the separated band. A heat sealing mechanism welds the wrapped layer band to the band underneath it and a cutting mechanism severs the leading edge of the band held by the second gripper mechanism which then becomes the trailing edge of the succeeding wrap. When the band is severed the ring drive mechanism is rotated in a reverse direction for the following load with the various gripping and cutting mechanisms functioning in the same manner.

Additional references of interest which are pertinent to rotatable drives for wrapping packages are disclosed in U.S. Pat. Nos. 3,820,451; 3,331,312; 3,324,789; 3,309,839; 3,207,060; 2,743,562; 2,630,751; 2,330,629; 2,054,603 and 2,124,770.

Other applications in packaging are shown by U.S. Pat. Nos. 3,514,920 and 3,793,798 in which heat shrink film is wrapped around a pallet supporting a plurality of cartons. A similar full web apparatus using a tensioned cling film is shown by U.S. Pat. NO. 3,986,611 while another apparatus using a tacky P.V.C. film is disclosed in U.S. Pat. No. 3,795,086.

The present invention uses stretchable plastic film in its preferred embodiment since the mechanical stretching of the film utilizes its strength better than heat shrink wrap and at less cost than netting, and can be used on loads where breathing is necessary or no heat can be applied to the product. The elasticity of the collapsed film holds the products under more tension than either the shrink wrap or the kraft wrap particularly with products which settle or relax when packaged.

Various apparatus and processes have been developed by the named inventors of this invention to utilize stretch material in package wrapping. Such apparatus and processes are disclosed in U.S. Pat. Nos. 3,867,806; 4,050,220; 4,077,179 and 4,079,565.

Additional benefits occur in the present invention over the prior art in that no changeover is required in handling random size units of a variety of materials as the apparatus is constructed to handle such random size units. Furthermore, the apparatus provides a substantially continuous wrapping operation so that loads can be wrapped at any desired speed and for any time period. A significant economic factor is also present in the present invention as the power requirements are significantly less than those of shrink systems since there is no heat tunnel required and greater speeds of operation are possible because of the elimination of the conventional heat seal which is used in non cling wrapping. Furthermore, a wider number of products can be handled by the present invention because of the elimination of the heat seal requirement. It should also be noted that adhesives do not work efficiently on narrow width film material due to the lack of gripping surface. Because of the simplicity of the construction of the invention there is a greater stability in the inventive wrapping apparatus with less maintenance being required to maintain the apparatus resulting in a corresponding reduction in breakdown time. Another desired characteristic resulting from the apparatus construction is that the invention does not take up much floor space.

SUMMARY OF THE INVENTION

The present invention generally comprises a novel process for automatically making spirally wrapped unitary packages having a breathable overwrap which is not heat sealed. In the process a series of loads, each containing a plurality of units are singularly fed onto a turntable adjacent a spiral wrapping apparatus.

The leading edge of the film from the film dispenser is held by a clamp mechanism of the turntable. As the turntable is rotated to wrap the load, the film is transported through a collapsing mechanism reducing the film web width as it is spirally wrapped around the load. After the film has been spirally wrapped so that it traverses both ends of the load the turntable is rotated at least 90° to offset the collapsed film web of the subsequent spiral wrap cycle so that the second cycle of collapsed film web wrap overlaps the original wrap forming an overwrap with a netting configuration. The film web is then severed from the film dispenser and tucked under one of the previous film wraps.

Alternately the collapsing mechanism may be removed while the base wraps are applied to achieve better bond between the pallet and load.

The above-mentioned purposes and operations of the invention are more readily apparent when read in conjunction with the following description of the drawings and the detailed description of the preferred embodiment of the present invention.

DETAILED DESCRIPTION OF THE DRAWINGS

Figure 1:
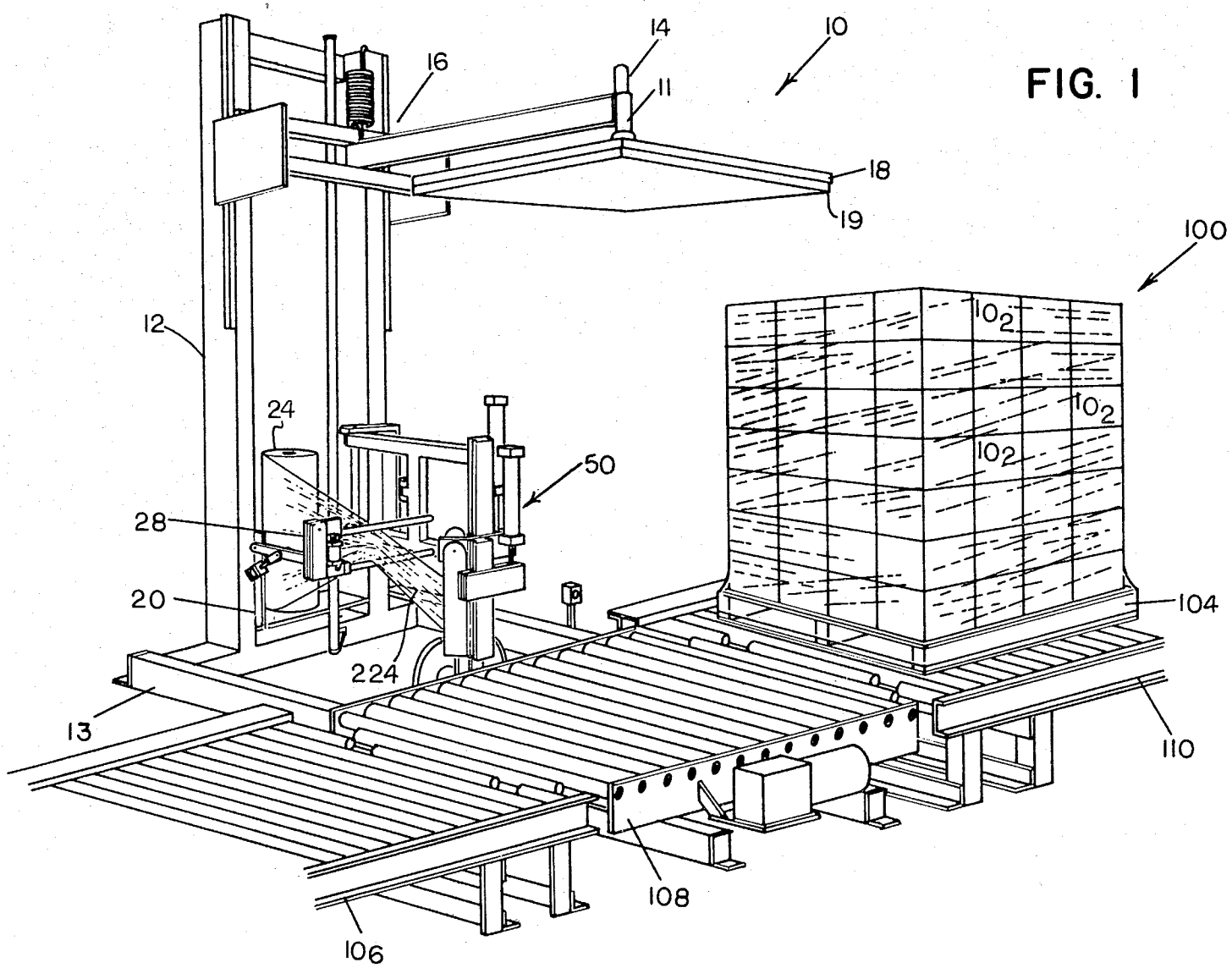
FIG. 1 is a perspective view of the wrapping apparatus used to perform the process.

The spiral wrapping apparatus 10 is most clearly shwn in FIGS. 1–5 with the operation of the apparatus being shown in FIGS. 6–14.

The spiral wrapping apparatus 10 comprises an upright frame 12 sitting on a base 13. A platen assembly 14 is mounted on the frame 12 for movement along the frame. The platen assembly comprises a support structure 16 moveably mounted to the frame and a platen 18 moveably mounted to the support structure. The platen has a flexible lower surface 19 which is adapted to be placed on the top of a load 100 comprising a plurality of unitary members 102 stacked on a pallet 104. The lower surface 19 of the platen is lowered onto the top of the load 100 after the load is carried by power conveyor 106 onto turntable 108.

When turntable 108 is rotated the platen rotates within journal 111 of the platen assembly holding the units in position on the load as the spiral wrap 120 is stretch wrapped around the load. The platen provides a force on the units 102 to prevent the units from being displaced or pulled from the load as the stretched film material is wrapped ariund the load.

A film roll support or carriage 20 is moveably mounted on the frame. The film roll carriage includes a film collapsing mechanism and a film roll mandrel or vertical holding member 21 which holds a roll of film of either a nylon, polypropolene, P.V.C. or other suitable composition from 6" to 30" in width. The film roll carriage can be mounted in guides or tracks in the frame and is preferably driven by a rack and pinion drive although chain, screw or other known drives could be readily adapted to the invention. The film roll is restricted by the action of a magnetic particle brake 26 which subjects the film material to a braking force causing it to stretch as it is wrapped around the load. The restrictive force is preferably applied by utilizing a roller not shown to engage the outside of the film roll and supply a constant force on the film roll uniformly stretching the film as it leaves the roll.

Figure 2:
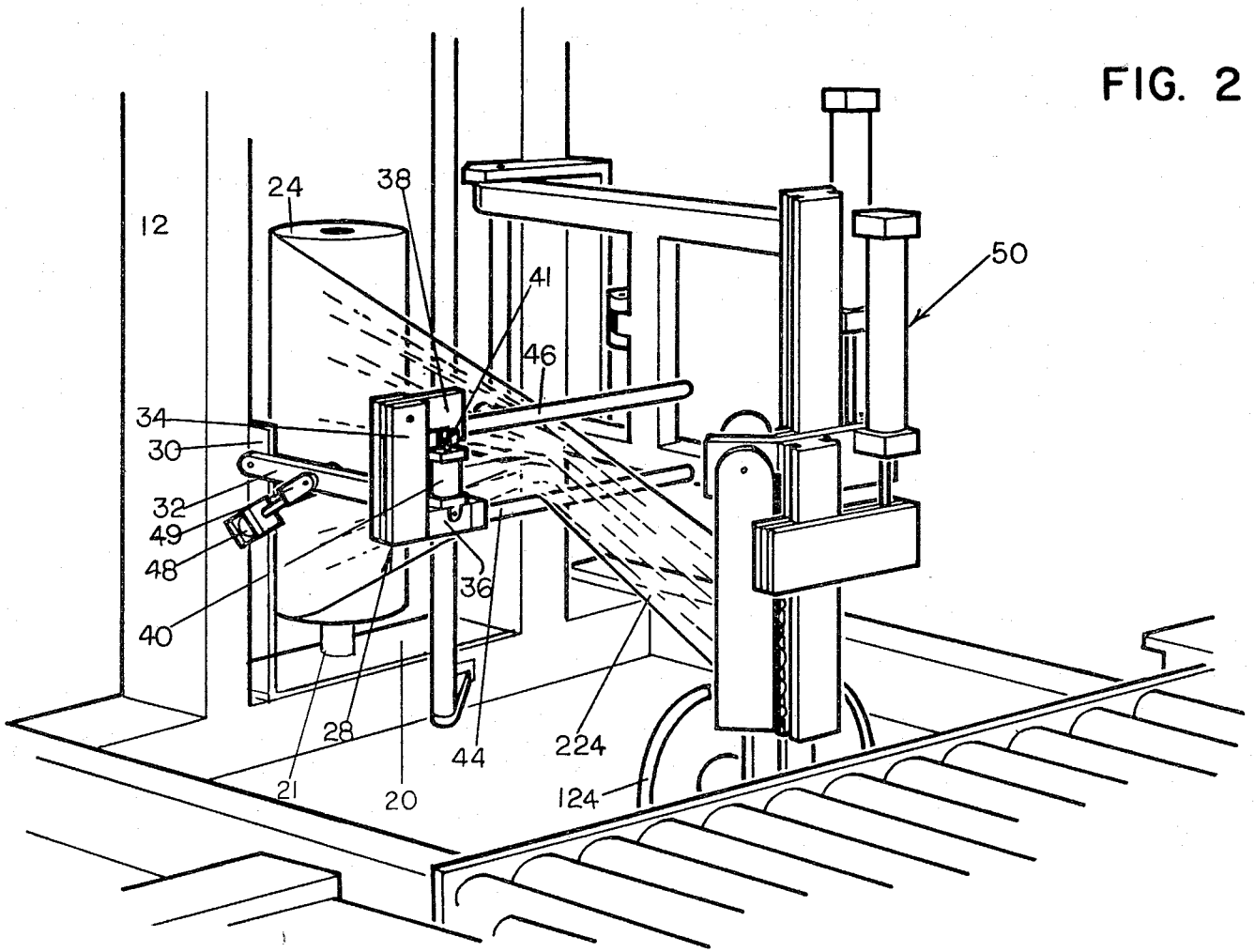
FIG. 2 is an enlarged isolated perspective view of the web collapsing mechanism, and clamping, cutting and tucking assemblies of the apparatus as shown in FIG. 1.
Figure 3:
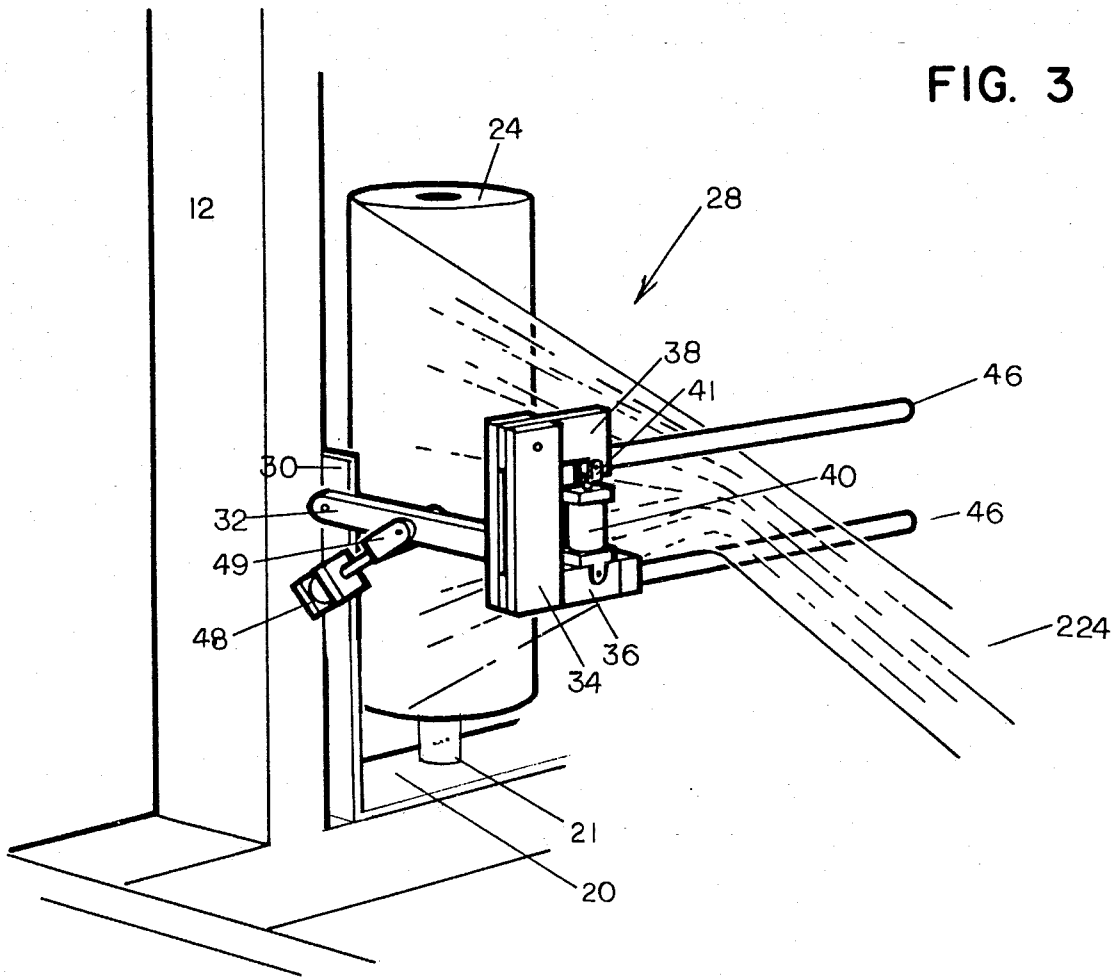
FIG. 3 is an enlarged isolated perspective view of one embodiment of the film web collapsing mechanism shown in FIG. 2.

It should be noted that film and film material are used interchangeably throughout the specification. The film as it comes off the film roll 24 is stretched by the brake 26 and passed through a film collapsing mechanism 28. The film collapsing mechanism which is best shown in FIGS. 2 and 3 comprises a support plate 30 secured to the carriage and slideably mounted on frame 12 and a rotatable support bar 32 having one end rotatably mounted to the support plate, the other end being secured to a support block 34. The support block 34 has a stationary leg 36 secured to it and a rotatable leg 38 rotatably mounted to the block above the stationary leg. A fluid activated cylinder 40 is mounted to the stationary leg 36 with an end 41 of its piston rod being connected by pin means to the rotatable leg 388. A linear rod 44 is secured to the stationary leg 36 and a similarly shaped moveable rod 46 is secured to the moveable rotatable leg 38.

A fluid activated cylinder 48 is secured to support plate 30 and has the end 40 of its piston rod connected to rotatable support bar 32. Thus cylinder 48 can be energized by known fluid circuitry to move the block 34 and its associated rods 44 and 46 up and down in a plurality of positions, so that rod 44 engages or does not engage the film web depending upon the mode of operation, while the cylinder 40 is energized to move the rotatable leg 38 and its associated rod 46 in an approximately 90° arc out of the path of the film, if the film is not to be collapsed for a particular sequence of wrapping. The film collapsing mechanism 28 is used to collapse the film width into a collapsed width approximating a rope-like configuration, although it will be appreciated that the width of the bunched film is greater than that which would normally be associated with a rope. In this regard the film width used with the invention ranges from 5" to 30" and is collapsed so that the film width is reduced from 30% to 70% depending upon the width of the film used. The collapsed film wrapped around the load is tucked into the load and severed from the load by a clamping, tucking and cutting mechanism 50. Alternate fastening of the film web is accomplished by heat sealing an overlying film web to an underlying film web.

Figure 4:
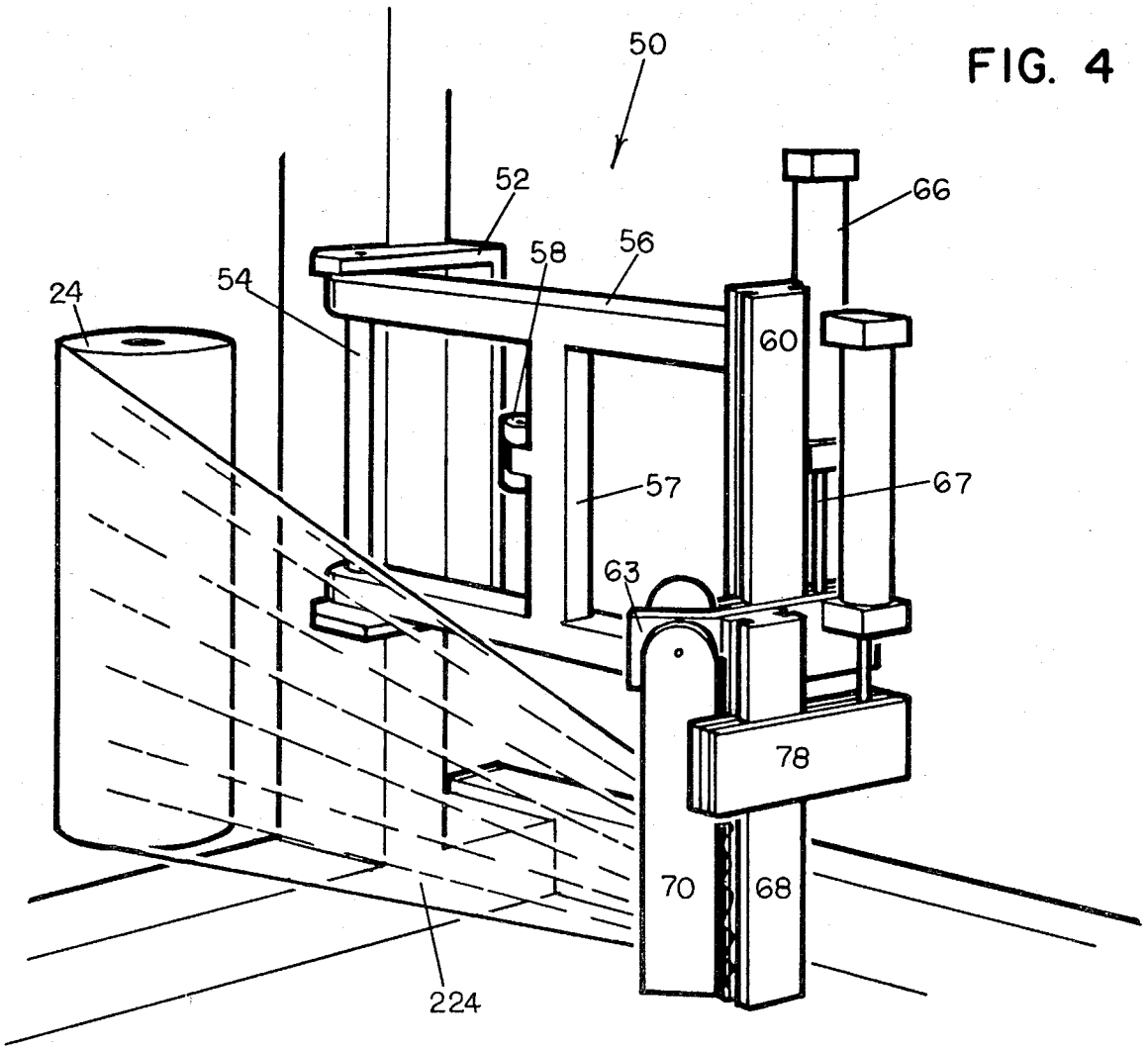
FIG. 4 is an enlarged isolated perspective view of the clamping, tucking and cutting assemblies shown in FIG. 4.

The clamping, tucking and cutting mechanism 50 is best shown in FIGS. 2 and 4 and is supported by a bracket 52 secured to the frame and a support rod 54 mounted in the bracket. The support rod 54 supports an H-shaped support member 56 which is rotatably moved around the support rod 54 by a fluid operated cylinder having its piston rod connected at 58 to the middle support arm 57 of the support member 56.

A grooved tuck guide bar 60 is secured to the ends of the H-shaped support member 56 and supports the clamping, cutting and tucking components of the apparatus.

Figure 5:
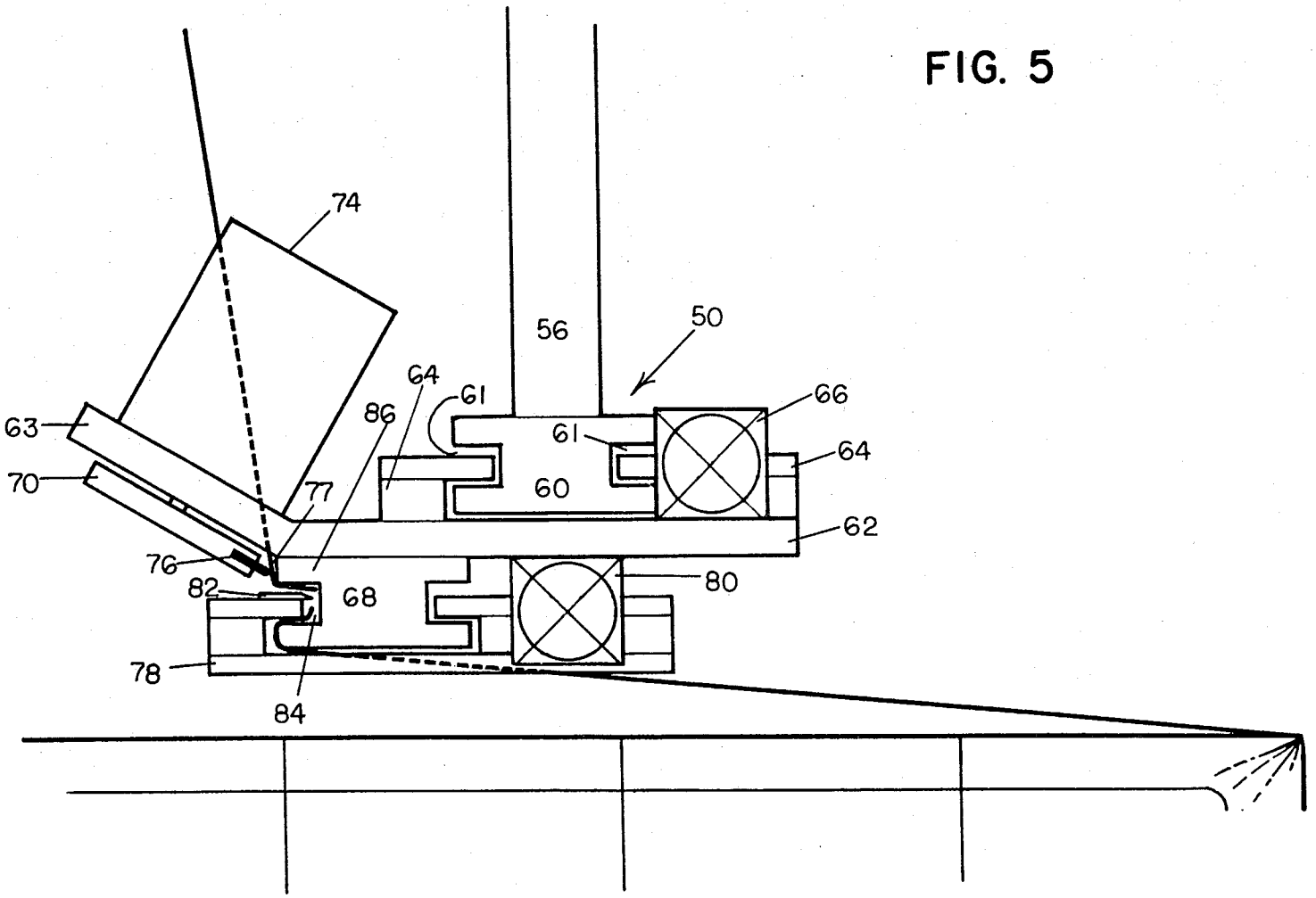
FIG. 5 is an enlarged plan view of the assemblies shown in FIG. 4.
Figure 7:
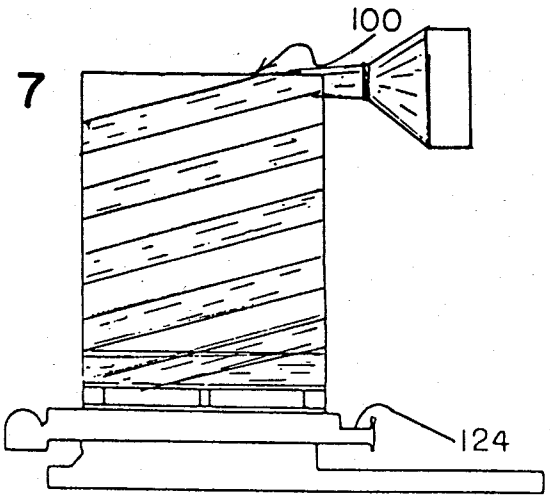
FIG. 7 is a side elevational view of the wrapping apparatus showing its wrapping operation in its first cycle up the load after the turntable clamp has been released.
Figure 9:
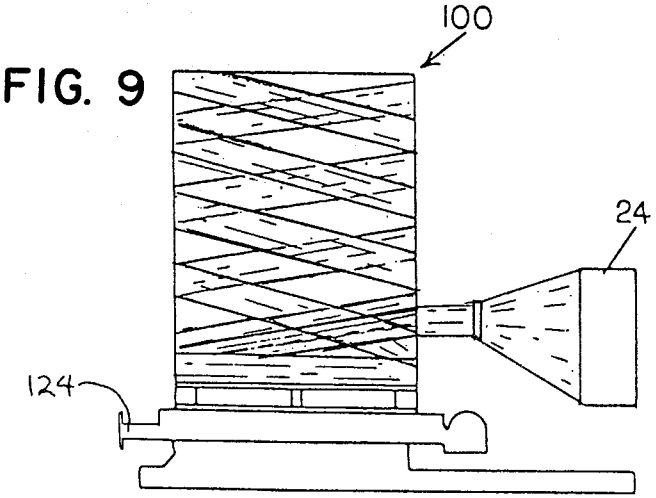
FIG. 9 is a side elevational view of the wrapping apparatus showing the rotation of the turntable before the start of the second wrap cycle.
Figure 6:
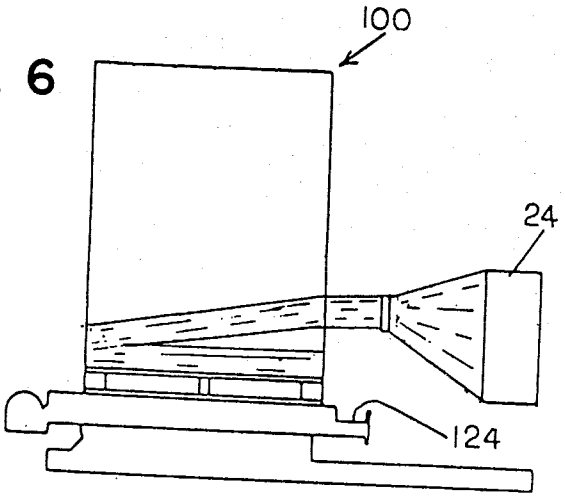
FIG. 6 is a side elevational view of the wrapping apparatus at the start of the wrap cycle.
Figure 8:
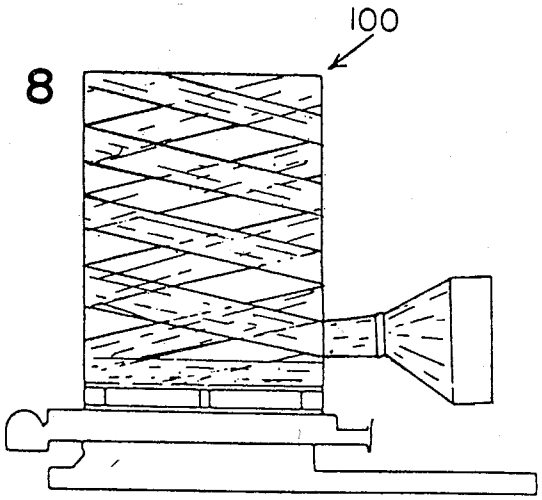
FIG. 8 is a side elevational view of the wrapping apparatus in its first cycle after the collapsed web has been spirally wrapped up the load and has started back down the load.
Figure 11:
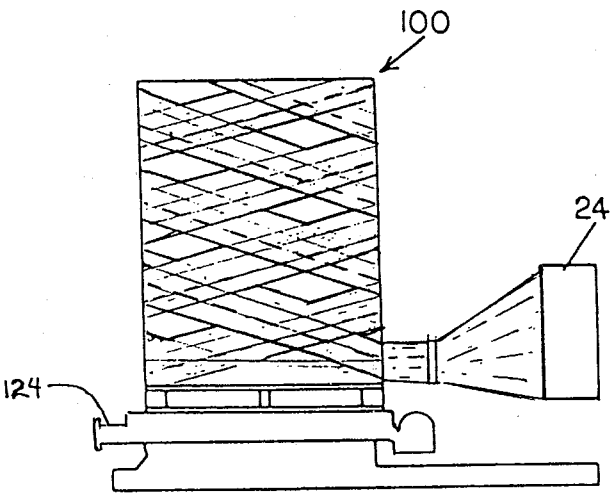
FIG. 11 is a side elevational view of the wrapping apparatus showing the second cycle in which the collapsed web overlaps the first cycle spiral wrap as it continues its wrapping operation down the load.
Figure 10:
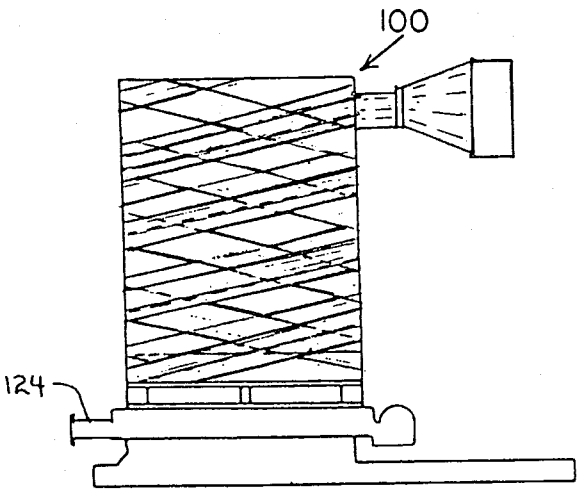
FIG. 10 is a side elevational view of the wrapping apparatus showing the second cycle in which the collapsed web overlaps the first cycle spiral wrap as it continues its wrapping operation up the load.
Figure 14:
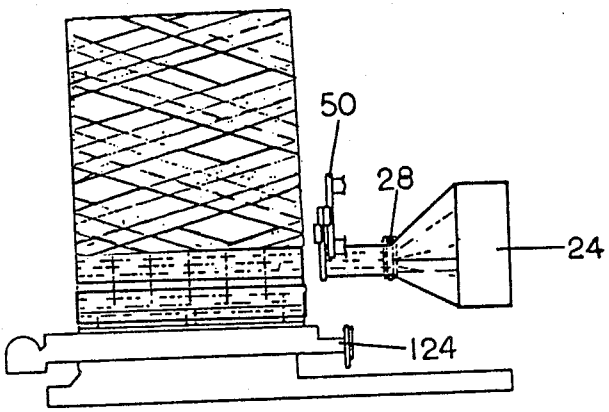
FIG. 14 is a side elevational view of the wrapping apparatus in which the severed leading edge of the collapsed film web is held for engagement by the turntable clamps for wrapping of the next load.
Figure 12:
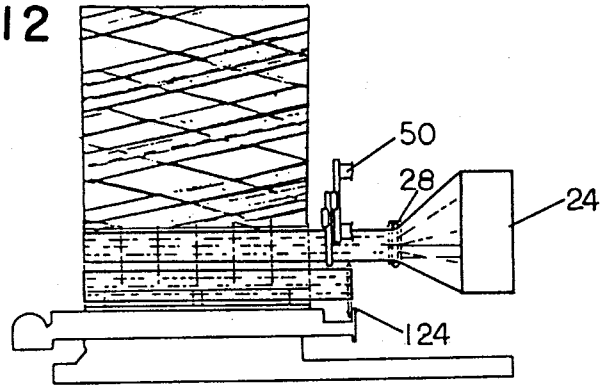
FIG. 12 is a side elevational view of the wrapping apparatus showing engagement of the cutting and clamping mechanism with the collapsed film web.
Figure 13:
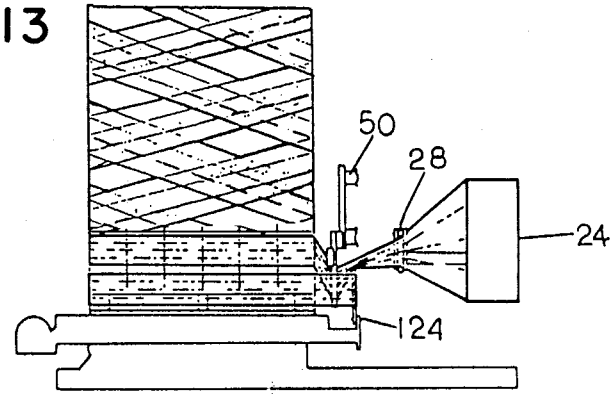
FIG. 13 is a side elevational view of the wrapping apparatus showing the wrapping mode in which the cutting and clamping mechanism tucks the collapsed film web under an underlying layer of collapsed film web.

A horizontally angularly bent clamp plate 62 having a guide assembly 64 secured thereto is adapted to seat and ride in the grooves 61 of the tuck guide bar 60. The clamp plate and its guide assembly is transported by a fluid operated cylinder 66 which is secured to the tuck guide bar 60. When cylinder 66 is energized its piston rod 67 which is secured to the guide assembly 64 pushes or pulls the bent clamp plate 62 along the tracks formed by grooves 61 of the guide bar 60. A grooved clamp bar 68 is secured to the horizontal clamp plate 62 and extends downward from the horizontal clamp plate perpendicular to the horizontal clamp plate 62. Adjacent to the grooved clamp bar 68 is a rotary clamp leg 70 which is rotatably mounted on the angled segment 63 of the horizontal clamp plate 62. The rotary clamp leg 70 is rotated by cylinder 74 and is rotated away from the clamp bar 68 before the clamp bar 68 is moved into the film path and is then returned toward the clamp bar 68, so that a flexible clamp strip 76 mounted to the clamp leg 70 engages the collapsed film and holds it in a clamped position against edge 77 of the clamp bar 68. This orientation is best shown by FIG. 5. A channelled cutter bar 78 is moveably mounted on the grooved clamp bar 68 and is reciprocated along the surface of the clamp bar by a fluid cylinder 80 which is secured to the horizontal clamp plate 62 and has its piston rod connected to cutter bar 78. When the collapsed film is held in the clamping assembly and the clamping assembly is fully extended as shown in FIG. 4, the cutter bar 78 is transported by the piston rod and slid along the surface of the clamp bar 68, so that a knife blade 82 mounted on the outer surface of the cutter bar 78 engages the stretched collapsed film tauntly held across groove 84 to sever the film. After the collapsed film is severed a new leading edge is held in the clamped position between the clamp strip 76 and edge 77 of leg 86 of clamp bar 68. The trailing edge returns to its normal memory position and pulls out of the groove 84 as is partially shown in FIG. 5.

Another element of the apparatus not previously described are the turntable clamps 124, which are rotated in the same manner as the rotary clamp leg 70. The function of the turntable clamps will be described more fully in the operation of the apparatus.

In the preferred and best mode of operation of the apparatus, the end of the stretched film webbing is manually pulled thrugh the film collapsing mechanism 28 and placed between the turntable clamps 124. At this stage the clamping, tucking and cutting mechanism 50 is in the retracted position, and the film collapsing mechanism 28 is closed by lowering the rotatable leg 38 and rod 46 in a down position. In another embodiment the film collapsing mechanism is in the form of a funnel with the width of the film gradually being diminished as it is transported through the funnel mechanism. In addition, an automatic threader can be used in place of manually pulling it through the film collapsing mechanism. However, it will also be appreciated that the film collapsing mechanism can be moved into and out of the film path so that a wrapping cylce can be initiated wherein a part of the load is wrapped with a stretched non collapsed film web.

The load 100 is moved onto the turntable 108 by power conveyor 106. The turntable is then rotated by an appropriate driving mechanism (not shown) which is well known in the art and braking force is applied to the web of collapsed stretchable material causing it to be substantially stretched anywhere from 2% to 200%. After one and one half revolutions of the turntable 108 the material roll support carriage 20 is driven upward carrying the film collapsing mechanism 28 and the turntable clamps 124 open. When the stretched collapsed film reaches the top of the load 100 the roll carriage stops its upward travel and remains in that position until a number of predetermined wraps are accumulated around the top of the load for stability or packaging reasons. Once the predetermined number of wraps (one or more) have been accumulated around the top of the load, the carriage moves downward carrying the film collapsing mechanism and its associated roll of film until it reaches its original position thereby covering the load with two spiral intersecting overwraps of stretched collapsed film material defining a plurality of angular spaces forming a symmetrical grid or mesh.

In some applications the film collapsing mechanism 28 does not engage the film web when the material roll support carriage is adjacent the base of the load, so that a full or opened web will be wrapped around the base of the load.

Alternatively the collapsing mechanism 28 may be removed from the film web at the top of the load, so that the full or opened web of material is wrapped around the top of the load to prevent crushing of delicate cartons. Thus either one of these alternatives is available in the wrapping process of the apparatus or both alternatives are available in the same wrapping cycle, so that a combination wrap of full stretched web material and collapsed stretch material can be used on a single package.

The turntable is then rotated 180° while the material roll is in an axially stationary position at he base of the load material roll support carriage is then driven upward carrying the film collapsing mechanism and dispensing stretched collapsing film in an overlapping position on the underlying wrap of the previous wrap. When the stretched collapsed film reaches the top of the load 100 the roll carriage stops its upward travel and remains in this position until at least one complete wrap is accumulated around the top of the load for stability, and the carriage then moves downwardly carrying the film collapsing mechanism and its associated roll of film dispensing collapsed film on the load so that it overlaps the original film wrap until it reaches its starting position. When the film reaches its original position and two wrap cycles have been completed the load has been covered with two overlapping spiral intersecting overwraps with the second layer of overwrap forming a smaller angular space between the intersecting wraps reduced at leat 25% from the original angular space to approximate the mesh or grids of a netting material. It should be noted in the present invention that in the preferred process the roll carriage is driven as fast as possible to increase the upward and downward force components on the film in a range of 0.10–0.50 to 1 ratio; with the 0.10–0.50 being the speed (distance travelled) of the carriage in relation to 1, the rotating speed of the load. It should also be noted that the process is also effective if the wrap is a three cycle wrap. In this process each time a cycle is completed the turntable is rotated 120°. In an extremely fast four cycle time approaching the 0.50 speed ratio the turntable is rotated 90° after each cycle is completed. Alternately depending upon the speed of the carriage in relation to the rotation of the load the wrap can be offset from the previous wrap 90° to 180°. The offset should be constant for each cycle.

It should further be noted that if a pallet is round, the intersecting film wraps form substantially symmetrical angular spaces with the space of the spacing depending upon the upward speed of the carriage. The side angles of the space change from approximately 45° at a 0.50 to 1 ratio to about 10° when the carriage speed is run at a normal speed of 2 ½ feet vertical movement per 16 feet of rotation of the pallet on the turntable. After the wrapping cycle is completed the turntable continues to rotate and the turntable clamps 124 come up from beneath the surface of the turntable while the turntable is rotated so that the material is wound around the turntable clamps. The turntable then stops in its home position and the clamping, tucking and cutting mechanism 50 is extended onto the material path by its cylinder to push the collapsed web of film positioned above the turntable clamps into the middle of a space defined by the outer surface of the load and a line drawn upward from the inner surface of the turntable clamps. The rotary clamp leg 70, which was previously in its raised position is rotated downward to clamp the material into a fixed position at which time the tuck cylinder 66 lower the horizontal clamp plate 62 and its associated members behind the turntable clamps. The cutter cylinder 80 then activates the cutter bar 78, so that the knife blade 82 is thrust downward cutting the bunched stretched material on the load side of the roped wrap while retaining the end of the stretched material leading to the supply roll to form a new leading edge of material. This leaves the severed end or trailing edge of collapsed material between the web wrapped around the turntable clamps and the load. The turntable clamps 124 release the collapsed material and are retracted, with the tuck cylinder 66 being activated to raise the horizontal clamp plate 62 and its associated assembly out of the path of the contracting collapsed wrap trapping the severed trailing edge of material underneath the contracting collapsed wrap as it returns to its original memory position.

The tuck cylinder 66 is activated to lower the clamping mechanism which is still clamping the new leading edge of material. The turntable clamps 124 then move upward to engage and hold the new leading edge of material as rotary clamp cylinder 74 rotates the rotary clamp leg 70 upward to release the stretched material, at which time the clamping, tucking and cutting mechanism 50 is carried away to its home position.

The wrapped load is then conveyed off of the turntable 108 by power conveyor 110 and the next load is conveyed onto the turntable adjacent the upstanding clamps holding the film web in place to begin the next wrap.

It should be noted that the steps of the wraping process can be interchangable in order without departing from the scope of the invention. Furthermore it is apparent that the initial steps in bringing the film web to the load can be interchanged and are equivalents.

In the foregoing description the invention has been described with reference to a particular preferred embodiment although it is to be understood that the specific details shown are merely illustrative and that the invention may be carried out in other ways without departing from the true spirit and scope of the following claims.

What is claimed is:

1. A process of spirally wrapping a web of stretch material on a load comprising a plurality of units to form a unitary package load with a breatheable overwrap comprising:

a. placing a roll of stretchable material on a dispenser means;

b. withdrawing said stretchable material from said dispenser means and collapsing the film web to reduce its width;

c. holding the leading edge of said film web adjacent a load comprising a plurality of units;

d. causing relative movement between said roll and said load so that stretched material is wrapped around said load;

e. moving said material roll along the axis of the load to form a spiral overwrap of stretched collapsible film on said load in which the spiral portions of the overwrap do not overlap and are spaced apart from each other;

f. reversing the direction of said movement of said stretched collapsed film overwrap to form a second spiral overwrap of stretched material of the same configuration as the first wrap over said first collapsed film web spiral overwrap to form a latticework of intersecting film web wraps;

g. moving the relative position of said load and said material roll to a position at least 90° removed from the position that it originally occupied when the material roll first moved along the axis of the load without axial movement of the material roll;

h. moving said material roll along the axis of the load while the load is rotating to provide a third spiral stretched collapsed film overwrap on said load of the same configuration as the first wrap which parallels the film web of the first wrap;

i. reversing the direction of said movement of said material roll while the load is rotating to provide a fourth spiral stretched collapsible film overwrap of the same configuration as the first wrap paralleling the film web of the second wrap on said load to form a latticework of overlapping film web wraps defining smaller spaces therebetween than the spaces formed by the original latticework; and j. fastening said film web underneath an underlying film web layer.

2. A process as claimed in claim 1 wherein said fastening is accomplished by heat sealing an overlying film web to an underlying film web.

3. A process as claimed in claim 1 wherein the film web is opened at the bottom of the load by allowing the film web to return to its original web width and at least one wrap of opened web is wrapped around said load.

4. A process as claimed in claim 1 wherein said film web is opened at the top of the load on the initial wrap by allowing the film web to return to its original web width and at least one film wrap of substantially opened film is wrapped around the top of the load.

5. A process as claimed in claim 1 wherein said stretchable material web has an original width ranging from 6 to 30 inches.

6. A process as claimed in claim 5 wherein said material web width is collapsed from 30 to 70 percent.

7. A process of making a unitary package from a load comprising a plurality of units comprising:

a. collapsing a film web from a roll of stretchable web material to reduce its width at least 30% as it is dispensed from the roll;

b. placing the leading edge of the collapsed stretchable web material against a load;

c. initiating relative movement between said load and said dispenser means to cause a sufficient amount of said web of material to be dispensed from said dispenser means to overwrap at least a part of said load;

d. moving the dispensing means in one direction along the surface of the rotating load to form a spiral collapsed film wrap on the surface of the load in which the spiral portions of the wrap do not overlap and are spaced from each other;

e. moving the dispensing means in an opposite direction back along the path which it originally travelled to form a spiral collapsed wrap of the same configuration as the previous wrap over the surface of the load which intersects the spiral wrap of the first wrap to form a net like configuration defining a plurality of geometric spaces;

f. rotating the load from 90° to 180° to a position removed from the start of the prior spiral wrap while maintaining the dispensing means in a stationary position;

g. moving the dispensing means in said one direction along the surface of the load to form a spiral collapsed wrap of the same configuration as the previous wrap on the surface of the load which overlaps the previous spiral wrap of the same direction;

h. moving the dispensing means in said opposite direction along the surface of the rotating load to form a spiral collapsed wrap of the same configuration as the previous wrap which overlaps the previous spiral wrap of the same direction to form a net like configuration defining a plurality of smaller geometric spaces than that of the previous spiral wrap; and i. fastening said collapsed film web to said load.

8. The process of claim 7 including the step of holding one of said collapsed web wraps away from said load and releasing the remotely held collapsed web once an adjacent web has been severed and tucked down into an area which could be encompassed and held by it.

9. A process for spirally wrapping a single web of stretched material around a load comprising a plurality of units to form a unitary package load with a breatheable overwrap comprising:

a. withdrawing a film material from a material roll carried on dispensing means and collapsing the film web to substantially reduce its width;
b. holding the leading edge of said collapsed film web adjacent a load comprising a plurality of units;
c. rotating said load to withdraw said film material from said dispensing means;
d. transporting said material roll along the axis of the load in a first direction while collapsing the film web to reduce its width to form a collapsed spiral film web overwrap in which the spiral portions of the wrap do not overlap and are spaced from each other on said load;
e. reversing the direction of movement of said material roll to form a similarly configured spiral collapsed film web overwrap on said load intersecting the initial spiral overwrap to form a latticework of intersecting film webs;
f. rotating said load to a position removed from the position that it originally occupied in its initial spiral wrap while maintaining the dispensing means in a stationary position to enable a subsequent cycle of wrapping along the axis of the load to overwrap the web disposed in the previous cycle;
g. moving said material roll along the axis of the load in said first direction while the load is rotating to form a similarly configured collapsed spiral film web overlapping the previous wrap of the same direction;
h. reversing the direction of said movement of said material roll while the load is rotating to form a similarly configured collapsed spiral film web which overlaps the spiral film web of the previous wrap of the same direction to form a latticework of overlapping film web wraps defining angular spaces therebetween which expose air directly to said load; and
i. fastening said collapsed material web to said load.

10. A process as claimed in claim 9 wherein said stretchable material web has an original width ranging from 10 to 20 inches.

11. A process as claimed in claim 10 wherein said material web width is collapsed more than 50 percent.

12. A process of making a unitary package from a load comprising a plurality of units comprising:

a. withdrawing a film web from a roll of stretchable material held by a dispensing means;
b. applying tension to the film web of stretchable material and collapsing it to substantially reduce its width and holding the collapsed film web in a fixed position adjacent a load so that the collapsed web is stretched as it is removed from said roll;
c. causing relative movement between said load and said roll so that stretched collapsed material is wrapped around said load;
d. moving the dispensing means in a first direction away from one end of the load to form a spiral wrap of collapsed web on the surface of the load, said spiral wrap having spaced portions and not overlapping;
e. moving the dispensing means in an opposite direction from its first direction away from the other end of the load to form a similarly configured spiral collapsed wrap on the surface of the load which is angularly positioned with respect to the prior spiral wrap to form a plurality of interstices;
f. rotating the load a predetermined amount while maintaining the film roll in a stationary position to begin a second spiral wrapping cycle which is initiated at a position substantially removed from the starting point of the first spiral wrap cycle;
g. moving the dispensing means in said first direction away from one end of the load to form a spiral collapsed wrap overlapping the previous cycle wrap of the same orientation reducing the area of the interstices of the previous cycle;
h. moving the dispensing means in said opposite direction from its first direction away from the other end of the load to form a spiral similarly configured collapsed wrap which is angularly positioned with respect to the previous spiral wrap and overlaps the previous cycle wrap of the same orientation further reducing the area of the interstices of the previous cycle; and
i. severing the collapsed web from said dispensing means and fastening the severed portion to said overwrap by placing it underneath an underlying film layer.

13. A process of making a unitary package from a load comprising a plurality of units as claimed in claim 12 wherein the interstices are symmetrical and angular.

14. A process of making a unitary package from a load comprising a plurality of units as claimed in claim 13 wherein the area of the interstices are reduced at least 25% on the second wrap cycle.

15. A process of making a unitary package from a load comprising a plurality of units comprising:

a. placing a roll of stretchable material on a dispensing means;
b. applying tension to the roll of stretchable material so that the material is stretched as it is removed from said roll;
c. positioning said stretchable material next to said load;
d. causing relative movement between said roll and said load so that stretched material is wrapped around said load;
e. transporting a web of stretchable material held by said dispensing means through a collapsing mechanism to substantially reduce its width;
f. moving the dispensing means at a constant speed in a direction parallel to the center axis of the load away from one end of the load a vertical distance ranging from 0.10 to 0.50 of the horizontal periphery around the load for every revolution of the load while the load is rotating to form an initial spiral wrap on the surface of the load having portions that are spaced from each other;
g. moving the dispensing means at the same constant speed to cover the same distance in an opposite direction away from the other end of the load while the load is rotating to form a second spiral wrap similarly configured to the initial spiral wrap which is angularly opposed to the initial spiral wrap on the wrapped surface of the load;
h. rotating the film roll relative to the load to begin a second spiral wrapping cycle which is initiated at a position at least 90° removed from the starting point of the initial spiral wrap while maintaining the dispensing means in a stationary position;

i. moving the dispensing means at the same constant speed in said first direction parallel to the center axis of the load away from one end of the load to form a similarly configured third spiral wrap on the surface of the load overlapping the second spiral wrap and parallel to the initial spiral wrap;

j. moving the dispensing means in said first opposite direction from its first direction away from the other end of the load to form a similarly configured fourth spiral wrap which is angularly opposed to the third spiral wrap on the wrapped surface of the load and overlaps the initial and third spiral wraps to complete a second spiral wrapping cycle, said fourth spiral wrap being parallel to the second spiral wrap; and k. fastening said web to an adjacent layer of film overlapping said load.

16. A process of making a unitary package from a load comprising a plurality of units comprising:

a. placing a leading edge of film web taken from a roll of stretchable material held by a dispensing means in a fixed position adjacent a load;

b. causing relative movement between said roll and said load so that material is wrapped around said load;

c. applying tension to the roll of stretchable material so that the material is stretched as it is removed from said roll and wrapped in an open orientation around the base end of the load;

d. moving the dispensing means in a direction parallel to the center axis of the load away from the base end of the load while collapsing the film web to reduce its width to form a spiral wrap on the surface of the load up to the top end of the load, said spiral wrap comprising a spiral web with spaced portions which do not overlap each other;

e. opening the collapsed film web by allowing the film web to return to its original web width and wrapping at least one layer of opened film wrap around the top end of said load;

f. collapsing the film web to reduce its width and moving the dispensing means in an opposite direction from the first direction away from the top end of the load to form a similarly configured collapsed second spiral wrap which is angularly opposed to the first spiral wrap on the wrapped surface of the load;

g. rotating the load to begin a second spiral wrapping cycle which is initiated at a position substantially removed from the starting point of the first spiral wrap cycle while maintaining said dispensing means in a stationary position;

h. moving the dispensing means in said first direction parallel to the center axis of the load away from the base end of the load to form a similarly configured collapsed third spiral wrap on the surface of the load overlapping the second spiral wrap;

i. moving the dispensing means in said first opposite direction from its first direction away from the top end of the load to form a similarly configured collapsed fourth spiral wrap which is angularly opposed to the third spiral wrap on the wrapped surface of the load and overlaps the third spiral wrap; and j. severing said collapsed web from said dispensing means and fastening the severed end of said collapsed web in a fixed position on said load.

17. A process as claimed in claim 16 wherein said film web is opened at the bottom of the load on the second wrap and at least one film wrap of substantially opened film is wrapped around the bottom of the load.

18. A process of spirally wrapping a web of stretchable material on a load comprising a plurality of units to form a unitary package load with a breatheable overwrap comprising:

a. placing a roll of stretchable material on a dispenser means;

b. withdrawing said stretchable material from said dispenser means and collapsing the film web to reduce its width;

c. holding the leading edge of said film web adjacent a load comprising a plurality of units;

d. causing relative movement between said roll and said load so that stretched material is wrapped around said load;

e. moving said material roll along the axis of the load to form a plurality of stretched collapsed spaced film web overwraps forming a helical first overwrap on said load, said helical overwrap comprising a film web with spaced portions which do not overlap each other;

f. opening the film web width by allowing the film web to return to its original web width at the top of the load and wrapping at least one film wrap of substantially opened film around the top of the load;

g. collapsing the film web to reduce its width and reversing the direction of said movement of the collapsed film web to form a helical second overwrap over the first overwrap and similarly configured to the first overwrap defining a lattice-work of intersecting film web wraps;

h. moving the relative position of said load and said film roll to a position at least 90° removed from the position that it originally occupied in its initial position prior to movement;

i. moving said material roll along the axis of the load while the load is rotating to provide a plurality of stretched collapsed film web overwraps forming a similarly configured helical third overwrap on said load which overlaps the film web of the second wrap and parallels the film web of the first overlap;

j. reversing the direction of movement of said material roll while the load is rotating to provide a plurality of stretched collapsed film web overwraps forming a similarly configured helical overwrap overlapping the wraps of alternating prior wraps on said load to form a latticework of overlapping film web wraps defining smaller spaces there-between than the spaces formed by the original latticework thereof;

k. opening the film web width of the bottom of the load and wrapping at least one film wrap of substantially opened film around the bottom of the load; and l. fastening the film web underneath the underlying film web layer.

19. A process as claimed in claim 9, including the step of opening the film web by allowing the film web to return to its original web width at the top of the load to a full web width on the initial spiral overwrap and wrapping at least one film wrap around the top of the load.

20. A process for spirally wrapping a web of stretchable material on a load comprising a plurality of units to form a unitary package load with a breatheable overwrap comprising:

a. placing a leading edge of film web taken from a roll of stretchable material held by a dispensing means in a fixed position adjacent a load;

b. applying tension to the roll of stretchable material so that the material is stretched as it is removed from the roll;

c. rotating said load to withdraw said stretchable material from said dispensing means and wrapping it around the base of said load;

d. collapsing the film web to reduce its width;

e. rotating said load while moving said dispensing means up and down said load in an initial wrap cycle to form a plurality of spiral overwraps of collapsed intersecting web material defining a plurality of interspaces, the spiral portions of each overwrap do not overlap and are spaced apart from each other;

f. rotating said load to initiate a second wrap cycle beginning at a different circumferential position on the load relative the axis of the load than the point of the start of the initial wrap and forming a plurality of spiral overwraps of collapsed intersecting web material similarly configured as said initial wrap and defining a plurality of interspaces; ascending portions of the different cycles formed while said dispensing means is moved up said load being substantially parallel to one another with the ascending portions of the second cycle at least partially overlapping the ascending portions of the initial cycle, and all descending portions of the different cycles formed while said dispensing means is moved down said load being substantially parallel to one another with the descending portions of the second cycle at least partially overlapping the descending portions of the initial cycle, interspaces in each wrap cycle being formed by the intersection of said ascending portions with said descending portions; and g. fastening said web to film wrapped around said load.

21. A process for spirally wrapping a web of stretch material on a load comprising a plurality of units to form a unitary package load with a breatheable overwap comprising:

a. placing a roll of stretchable film material on a dispenser means;

b. withdrawing said material from said dispenser means and collapsing the film web to reduce its width;

c. holding said collapsed film web adjacent to said load and applying tension to said collapsed film web causing it to be stretched as it is withdrawn;

d. rotating said load to withdraw said stretched material from said dispensing means while moving said material reciprocally along the axis of the load in an initial wrap cycle, to form a plurality of stretched collapsed spiral film web overwraps on said load of different orientations, each of said overwraps comprising a spiral web with spaced portions which do not overlap and are spaced apart from each other;

e. offsetting the load to a different circumferential position relative to the axis of the load from the position of the start of the initial wrap before beginning a second spiral wrap cycle;

f. completing a second wrap cycle around the load with a similar configuration to the initial wrap cycle occupying a different position on the load than the initial wrap cycle with spaced spiral portions of the overwraps of the second wrap cycle being substantially parallel to other overwraps of the initial wrap cycle formed in the same orientation and direction along the axis of the load, and intersecting other overwraps formed in the opposite orientation and direction along the axis of the load; and g. fastening said film web to an underlying film web layer.

* * * * *